United States Patent [19]

Veyret

[11] Patent Number: 5,058,658

[45] Date of Patent: Oct. 22, 1991

[54] INSTALLATION FOR THE CONTINUOUS CASTING OF THIN METAL PRODUCTS BETWEEN TWO ROLLS

[75] Inventor: Jean-Bernard Veyret, Metz, France

[73] Assignee: Usinor Sacilor, Puteaux, France

[21] Appl. No.: 616,347

[22] Filed: Nov. 21, 1990

[30] Foreign Application Priority Data

Dec. 7, 1989 [FR] France ..... 89 16320

[51] Int. Cl.[5] ..... B22D 11/06

[52] U.S. Cl. ..... 164/428; 164/480

[58] Field of Search ..... 164/428, 480

[56] References Cited

FOREIGN PATENT DOCUMENTS 0212423 3/1987 European Pat. Off. .

1-215440 8/1989 Japan ..... 164/428

OTHER PUBLICATIONS

Patent Abstracts of Japan, vol. 9, No. 264 (M-423) 1987) Oct. 22, 1985, Continuous Casting Method of Thin Sheet: and JP-A-60111743 (Mitsubishi); 6/85.

Patent Abstracts of Japan, vol. 12, No. 495 (M-780) (3342) Dec. 23, 1988, Twin Roll Type Continuous Casting Machine; and JP-A-63215343 (Nisshin Steel) 9/7/88.

*Primary Examiner*—Kuang Y. Lin

*Attorney, Agent, or Firm*—Frishauf, Holtz, Goodman & Woodward

[57] ABSTRACT

The casting installation is of the type in which the ingot mould is essentially constituted by two rolls (1, 1') which are energetically cooled, substantially horizontal and parallel and rotate in opposite directions, and two lateral closing plates (5), termed "side dams", each maintained in contact with an end of each roll. According to the invention, the rolls (1, 1') have end portions of frustoconical shape and the contact between the rolls and the side dams occurs between the lateral surfaces (4a) of these frustoconical end portions and surfaces (7) of the peripheral parts (9) of the side dams which match their shape. Preferably, the parts (9) of the side dams in contact with the rolls are of ceramic.

10 Claims, 2 Drawing Sheets

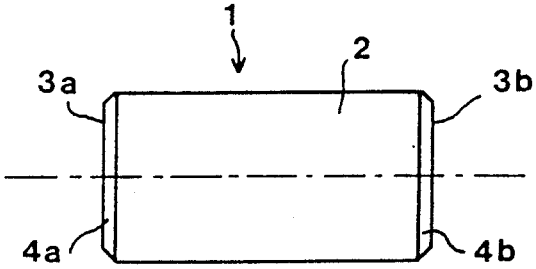
FIG. 1
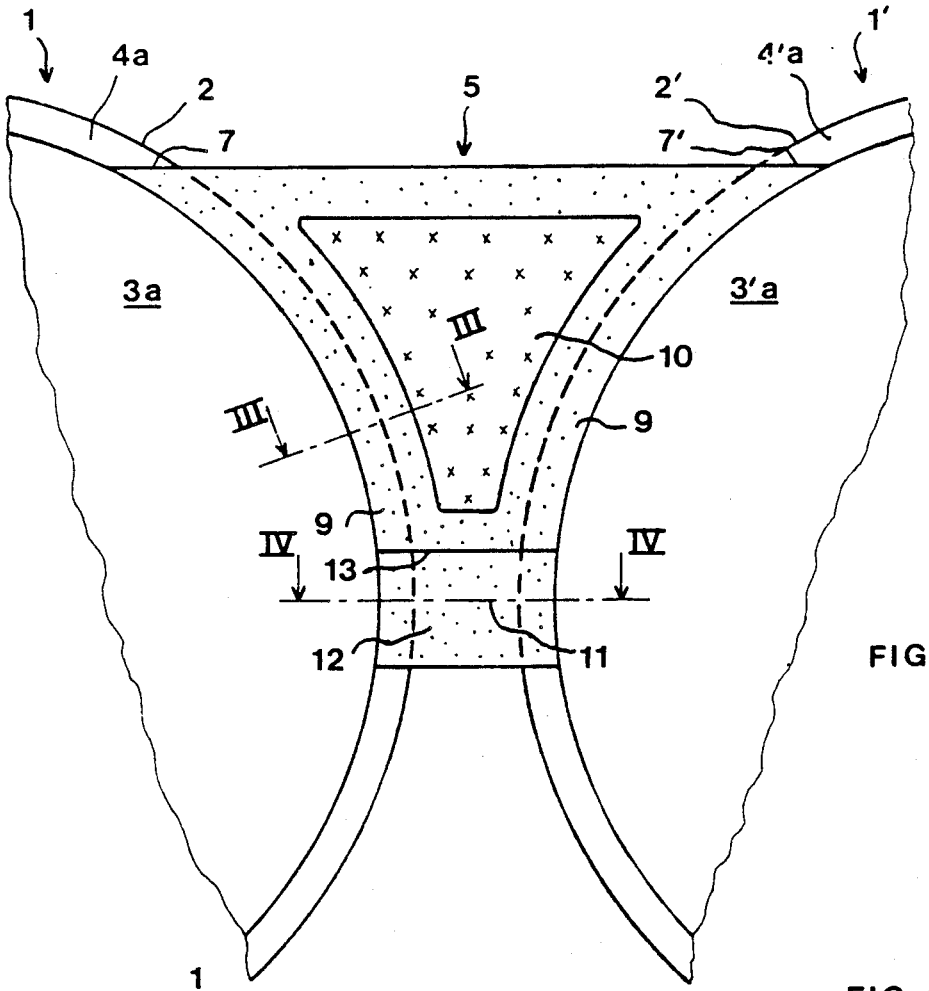
FIG. 2
FIG. 3
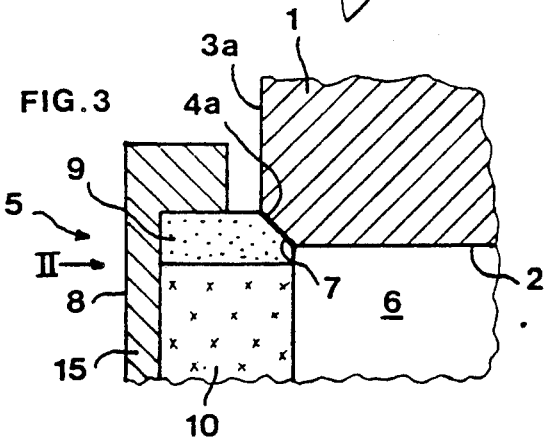
FIG. 4
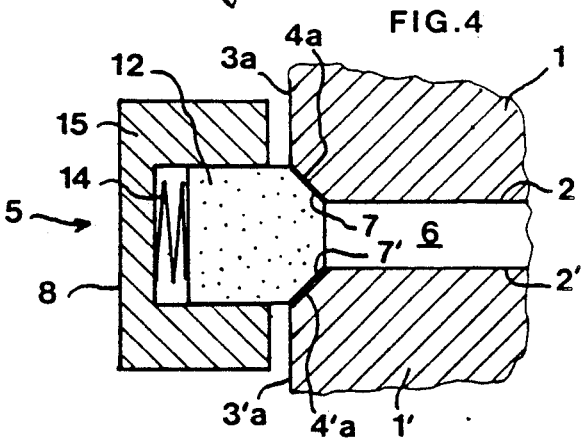

INSTALLATION FOR THE CONTINUOUS CASTING OF THIN METAL PRODUCTS BETWEEN TWO ROLLS

The invention relates to the continuous casting of thin products of metal, in particular steel, in installations the ingot mould of which is essentially constituted by two parallel energetically cooled rolls which are horizontal or substantially horizontal and rotate in opposite directions. More precisely, it relates to the means for laterally closing the casting space defined between the two rolls.

To achieve this lateral closure, it is known to employ fixed walls, termed "side dams", which have a vertical surface placed flat against the ends of the rolls. On of the problems which must be solved in a satisfactory manner is that of the seal between the side dams and the rolls for avoiding seeping of molten metal out of the casting space which would impair the quality of the product and deteriorate the machine.

Usually, the casting rolls have a perfectly cylindrical shape with in particular sharp edges between the lateral surface and the end surfaces. The side dams may be planar throughout their zones in contact with the end surfaces of the rolls. This provides a planar contact between the rolls and the side dams. They may also include a projecting portion which extends into the space between the rolls: each roll is then in contact not only with the planar part of the side dam but also with one of the lateral surfaces of the projecting portion of the side dam. This provides a contact in the shape of a right-angled wedge between the rolls and the side dams.

With such contacts, it is difficult to maintain a constantly satisfactory sealing of the casting space. Indeed, the wear of the side dams must be as small and homogeneous as possible throughout the area of contact with the rolls. Now the larger this area the greater the chances are that the wear will be heterogeneous. Moreover, usually these side dams must be made from a refractory material having good insulating properties, such as silica foam or dossolite so as to limit as far as possible the solidification or freezing of the metal on their surface. But these insulating properties are hardly compatible with a high resistance to abrasion.

An object of the invention is to propose a configuration of the lateral parts of the top of a machine for casting between rolls, including the rolls and the side dams, which permits limiting as far as possible the seeping of the liquid metal out of the casting space.

The invention therefore provides a device for the continuous casting of thin metal products, of the type in which the ingot mould is essentially constituted by two parallel substantially horizontal energetically cooled rolls rotating in opposite directions, and two lateral closing plates, termed "side dams", each maintained in contact with an end of each roll and defining the casting space (which thus has a substantially constant size and shape) in cooperation with the cooled lateral surfaces of the rolls, in which; the rolls have end portions of frustoconical shape and the contact between the rolls and the side dams occurs between the lateral surfaces of said frustoconical end portions and parts of said side dams which match their shape.

In a preferred embodiment, the parts of the side dams in contact with the rolls are of ceramic and the major part of the area of the side dams in contact with the liquid steel is of a refractory material.

As will have been understood, the invention provides for the roll-side dam contacts a shape which is particularly advantageous in the establishment of a good seal. Further, the use of ceramic results in low wear of the corresponding zones of the side dams and guarantees a satisfactory maintenance of this seal during the whole of the casting.

This conical contact has over the planar or projecting contacts employed heretofore and previously described the advantage of a reduced area of contact between the rolls and the side dams. This minimizes the surfaces whose machining must be of excellent quality to maintain a good seal. Further, this configuration easily takes up play which could result from wear of the side dams.

A better understanding of the invention will be had from the following description with reference to the accompanying drawings in which:

FIG. 1 shows a roll of the particular type employed in the described installation;

FIG. 2 is a diagrammatic partial side elevational view in the direction of arrow II in FIG. 3 of a machine for continuous casting between rolls according to the invention;

FIG. 3 is a sectional view taken on line 3—3 of FIG. 2;

FIG. 4 is a sectional view taken on line 4—4 of FIG. 2;

Figure 5:
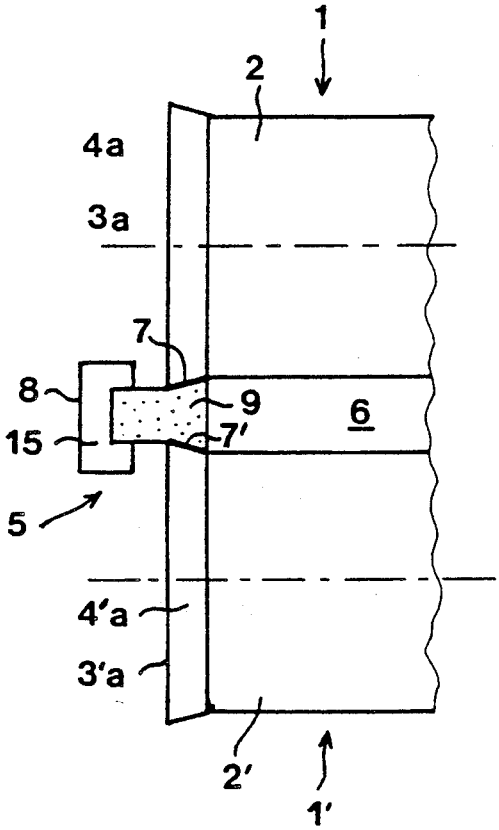
FIG. 5 is a semi-plan view of a machine according to the invention in which the end portions of the rolls have a conicity which is the opposite of the preceding conicity.

FIG. 1 shows a roll 1 for mounting on a machine for the continuous casting of thin metal products according to the invention. FIGS. 2 and 4 also show the second roll 1' identical to the roll 1 and disposed parallel to the latter, their respective axes being contained in a common horizontal plane. These rolls are energetically cooled by an internal circulation of water (not shown).

Instead of having sharp edges between their cooled lateral surface 2, 2' and their end surfaces 3*a*, 3*b*, 3'*a*, these rolls have end portions of frustoconical shape each defining a conical surface 4*a*, 4*b*, 4'*a* which is employed as a bearing or support surface for the side dams. In the illustrated embodiment, the conicity is in the direction of a reduction in the section of the end portions of the roll relative to the section of the median portion of the roll.

FIGS. 2, 3 and 4 diagrammatically represent one embodiment of the invention. Added to the rolls 1, 1' rotating in the directions indicated by the arrows just described are two side dams only the side dam 5 of which is shown laterally closing the casting space 6 to then have a predetermined substantially constant size and shape defined by the lateral surfaces 2, 2' of the rolls so as to impart thereto a rectangular section whose width decreases as one descends through the machine. According to the invention, formed on the side dam 5 are two curved surfaces 7, 7' which, once the side dam is placed in position, match the conical surfaces 4*a*, 4'*a* of the rolls. The surfaces 4*a*, 4'*a*, 7 and 7' are precisely machined so as to ensure a contact of excellent quality. As shown in FIG. 4 which a pressure applied on the rear 8 of the side dam by known means (not shown) contributes to create this excellent contact. In the preferred embodiment represented in these Figures, these curved surfaces are provided on a part 9 of the side dam made from ceramic and constitute the periphery thereof. Indeed, in contrast to conventional refractory materials usually employed for the construction of side dams, these materials are distinguished by a distinctly improved resistance to wear and mechanical properties. Now, these features present determinant advantages if a durable sealed contact is to be achieved between the rolls and the side dam.

This portion of ceramic which is made from a material such as that known under the trademark SYALON, boron nitride, silicon nitride, aluminium nitride, zirconia, chromium carbide, constitutes in the presently-described embodiment, as already mentioned, only the periphery of the side dam. Indeed, it is generally not desirable to make the whole of the side dam from ceramic since its cost would be excessively high and above all its insulating properties would be insufficient and would result in an excessive solidification of the steel on its surface. This is why the ceramic part 9 constitutes only the frame of the active part of the side dam, the core 10 of the latter, which represents the major part of its surface in contact with the liquid steel, being made from a refractory material of the type conventionally employed for making the side dams based on silica or alumina. Note that FIG. 2 is merely a diagrammatic representation in which the ratio of the dimensions of the various parts is not respected in order to render the Figure more clear. It must be understood that in fact the rolls 1, 1' have a diameter of at least several tens of centimetres whereas the minimum distance between their lateral surfaces 2, 2' in the region of the neck 11 defining the thickness of the product, is of the order of a few millimetres (for example 5 to 10 mm). As concerns the side dam 5, its height must be sufficient to allow a depth of a few tens of centimetres for the well of liquid metal in the ingot mould. In reality, the core 10 of refractory material therefore represents a proportion of the total area of the side dam which is substantially larger than that shown in FIG. 2.

In the known manner, machines for casting metal products between rolls sometimes include on each of the side dams a member termed a "shoe" which closes the casting space in the zone just above and just below the neck. The feature of the shoe is that it is made from a material which is substantially more resistant to mechanical stresses and abrasion than the remainder of the side dam, for example a metallic material, since it is in contact with the metal which is in major part or completely solidified which may exert a rolling force thereon. In order to attenuate this force, it is also known to mount the shoe on an elastically yieldable support allowing a certain amount of retraction on its part.

The side dam according to the invention may also include a shoe 12 made from ceramic, shown in FIGS. 2 and 4. If it is mounted in an elastically yieldable manner owing to a device symbolically represented by the spring 14, it is advantageous to arrange that the portion of the side dam against which it rubs is also of ceramic: there is thus provided a ceramic-ceramic contact 13 which has a good resistance to wear and whose sealing quality may remain satisfactory throughout the use of the side dam. If it is not desired that the shoe have elasticity, the simplest solution is of course to incorporate it in the side dam by construction.

The side dams may be inserted in a support 15 (not shown in FIG. 2) comprising elements (not shown) well known in the art which enable the side dams to be placed flat against the rolls. Alternatively, the ceramic and refractory parts may be deposits on a plate, for example of metal. In this case, zirconia is particularly adapted to this use for the parts of ceramic owing to the ease with which it can be adhered to a metal support.

In order to obtain an additional reduction in the wear of the side dams at their contact with the rolls, it is also possible to provide a deposit of ceramic on the conical bearing surfaces 4*a*, 4*b*, 4'*a* of the rolls. This contact may also be lubricated, for example by depositing continuously or discontinuously thereon boron nitride powder, or any other powdered or liquid material which is capable of performing a similar function.

It must be understood that the scope of the invention is not intended to be limited to the embodiment just described and illustrated. In particular, the side dams may include in the known manner in their central part an element projecting into the casting space, termed insert, which may be of a conventional refractory material, ceramic or any other material and serve to improve the conditions of solidification of the product. Further, the rolls may include on their lateral surface at each of the ends of the cylindrical part, a hollow engraving adapted to encourage the fastening of the solidified skin of the product on the roll. However, if this engraving is placed at the extreme limit of the cylindrical part and is flush with the zone of contact between the roll and the side dam, there is a danger that it will encourage the seeping of the liquid metal. Consequently, it is preferable to dispose these engravings in a position set back a few millimetres from said zone of contact.

Instead of possessing end surfaces of reduced section relative to the median section as just described and illustrated, the rolls may, on the contrary, have outer end surfaces of larger section than the median section. The geometry of the periphery of the side dams must then be modified relative to the previously-described configuration: its end portion has a divergent rather than a convergent shape. The contact between the rolls and the side dams is this time achieved by means of a traction exerted on the supports of the side dams and no longer a pressure. FIG. 5 shows such a configuration, the various elements of the installation being designated by the same reference numerals as before.

What is claimed is:

1. Apparatus for the continuous casting of thin metal products, in particular steel, comprising an ingot mold, said ingot mold, including:

two substantially horizontal and parallel rolls rotatable in opposite directions, each of said rolls having first and second end portions each having a frustoconical shape, and a cooled lateral surface;

first and second lateral closing plates respectively forming first and second side dams, said first side dam being in contact with said first end portions of said rolls, and said second side dam being in contact with said second end portions of said rolls;

said side dams and said cooled lateral surfaces of said rolls together defining a predetermined substantially constant size and shape casting space;

said side dams having beveled contact portions which have a frustoconical shapes where said first and second end portions of said rolls contact said side dams;

the frustoconical shape of said first and second end portions of said rolls matching the frustoconical shape of said beveled contact portions of said side dams where said beveled portions contact said rolls to maintain said rolls in relative position and to maintain said predetermined substantially constant size and shape of said casting space.

2. The apparatus according to claim 1 in which a liquid metal is provided to said ingot mold when casting is occurring, each of said side dams comprising:

a major portion thereof in contact with said liquid metal being formed of a refractory material; and said frustoconical shaped beveled contact portions of said side dams being formed of a ceramic material.

3. The apparatus according to claim 2, further comprising means for urging each of said side dams to maintain said contact with said rolls.

4. The apparatus according to claim 2, wherein each of said side dams further comprises a support plate; said ceramic and refractory portions of said side dams being deposited on said support plate.

5. The apparatus according to claim 2, wherein said rolls define therebetween a neck for the passage of a cast product; and further comprising a shoe positioned to be in contact at a given area with each of said side dams, said shoe also being positioned below each of said side dams, said shoe exerting a pressure on said cast product in the vicinity of said neck, said shoe being formed of a ceramic material; said given area of said side dams in contact with said shoe being formed of a ceramic material.

6. The apparatus according to claim 2, wherein said ceramic portions are formed of a material selected from the group consisting of: a material known under the trademark SYALON; boron nitride; silicon nitride; aluminum nitride; zirconia and chromium carbide.

7. The apparatus according to claim 3, wherein said ceramic portions are formed of a material selected from the group consisting of: a material known under the trademark SYALON; boron nitride; silicon nitride; aluminum nitride; zirconia and chromium carbide.

8. The apparatus according to claim 4, wherein said ceramic portions are formed of a material selected from the group consisting of: a material known under the trademark SYALON; boron nitride; silicon nitride; aluminum nitride; zirconia and chromium carbide.

9. The apparatus according to claim 1, further comprising lubricating means for lubricating said contact surfaces between said end portions of said rolls and said side dams.

10. The apparatus according to claim 9, wherein said lubricating means comprises boron nitride powder.

* * * * *